US007168991B2

(12) United States Patent
Sano

(10) Patent No.: US 7,168,991 B2
(45) Date of Patent: Jan. 30, 2007

(54) DETACHABLE CONNECTOR AND FRONT-PANEL DEVICE INCLUDING SAME

(75) Inventor: Noriyuki Sano, Imaichi (JP)

(73) Assignee: Alpine Electronics, Inc., Tokyo (JP)

( * ) Notice: Subject to any disclaimer, the term of this patent is extended or adjusted under 35 U.S.C. 154(b) by 0 days.

(21) Appl. No.: 11/369,167

(22) Filed: Mar. 6, 2006

(65) Prior Publication Data

US 2006/0252291 A1 Nov. 9, 2006

(30) Foreign Application Priority Data

Mar. 16, 2005 (JP) ..... 2005-075455

(51) Int. Cl.
*H01R 24/00* (2006.01)

(52) U.S. Cl. ..... 439/660; 439/376

(58) Field of Classification Search ..... 439/74, 439/660, 376, 341

See application file for complete search history.

(56) References Cited

U.S. PATENT DOCUMENTS 5,306,163 A * 4/1994 Asakawa ..... 439/74
5,626,483 A * 5/1997 Naitoh ..... 439/74
5,852,594 A 12/1998 Kaise et al.
6,059,580 A * 5/2000 Konno et al. ..... 439/74
6,062,875 A * 5/2000 Konno et al. ..... 439/74
6,071,129 A * 6/2000 Konno et al. ..... 439/74
6,379,191 B1 * 4/2002 Goetz et al. ..... 439/660
6,527,584 B2 * 3/2003 Ninomiya ..... 439/500
6,629,849 B2 * 10/2003 Yu ..... 439/74
2006/0051988 A1 * 3/2006 Okura et al. ..... 439/74

FOREIGN PATENT DOCUMENTS

JP 6011268 2/1994

* cited by examiner

*Primary Examiner*—Tulsidas C. Patel
*Assistant Examiner*—PhuongChi Nguyen
(74) *Attorney, Agent, or Firm*—Brinks Hofer Gilson & Lione

(57) ABSTRACT

A detachable connector is provided in which a male connector unit mounted to a movable panel is attachable to and detachable from a female connector unit mounted to a main body. In a pair of first and second female terminals, the first female terminal which has a longer distance to an axis of rotation of the movable panel includes a sloped portion for being elastically in contact with a leading-end corner of a convex contact of the male connector unit from obliquely above, and the second female terminal includes a contact portion for being elastically in contact with the side surface of the convex contact from below. When the male connector unit is attached to the female connector unit, the sloped portion is in contact with the convex contact at a position that is more distant from the movable panel than the contact portion.

19 Claims, 10 Drawing Sheets

DETACHABLE CONNECTOR AND FRONT-PANEL DEVICE INCLUDING SAME

BACKGROUND OF THE INVENTION

1. Field of the Invention

The present invention relates to a detachable connector that is included in a front-panel device in which a front portion of a main body is openable/closable by a movable panel rotatably mounted to the main body and that is capable of attaching a male connector unit to a female connector unit and detaching the male connector unit from the female connector unit with the rotation of the movable panel.

2. Description of the Related Art

For a vehicle-mounted electronic apparatus, such as a mini disk (MD) player or compact disk (CD) player, in order to reduce the size and profile of the electronic apparatus and to ensure a required space for arranging a display screen of, for example, a liquid crystal display and various operating keys, a front-panel device is known in which a front portion of a main body of the apparatus is formed so as to be openable/closable by a rotatably mounted movable panel. In the front-panel device, the front portion of the main body includes a loading slot for receiving an inserted medium, such as a MD or CD, the display screen and various operating keys are disposed on the movable panel rotatably mounted to the main body, the movable panel normally stands vertical at a position in which the loading slot is covered, and the movable panel is rotated frontward only when the loading slot is required to be exposed.

Such a front-panel device with a movable panel detachable from a main body of an apparatus is known. Detaching the movable panel from the main body allows the vehicle-mounted electronic apparatus to appear as a semifinished product while a driver is not in a car, thus enhancing the effect of protecting the electronic apparatus from theft. In this case, an electrical connection between the movable panel and the main body is typically realized by means of a detachable connector including a male connector unit mounted in the movable panel and a female connector unit mounted in the main body.

A known detachable connector of this kind has a structure in which the female connector unit in the main body includes a plurality of sets each including a first female terminal and a second female terminal, the first and second female terminals being disposed substantially symmetrically with respect to a line, the male connector unit in the movable panel includes a plurality of convex contacts, and the convex contacts are capable of being inserted into the gaps between the corresponding first and second female terminals and being ejected from the gaps. Each of the first female terminals and each of the second female terminals are provided with corresponding elastic members disposed on opposite sides of an insertion path for allowing each of the corresponding convex contacts to pass therethrough so as to be opposed to each other and be capable of approaching and moving away from each other. When the male connector unit is attached to the female connector unit, each of the female terminals is obliquely in contact with each of the adjacent sections of the leading ends of the convex contacts in an elastic manner (see, for example, Japanese Registered Utility Model No. 2551493).

In such a known detachable connector having the schematic structure described above, when the movable panel is moved to the closed position in which the front portion of the main body is covered, the convex contact of the male connector unit mounted in the movable panel is inserted into the insertion path in the female connector unit, the gap between the first and second female terminals is expanded, and the convex contact is into contact with both the first and second female terminals in an elastic manner. As a result, an electrical connection between the movable panel and the main body is established. On the other hand, when the movable panel is moved from the closed position to the open position in which the front portion of the main body is exposed, the convex contact moves away from the first and second female terminals, and the convex contact is ejected from the insertion path. As a result, the electrical connection between the movable panel and the main body is released. In order to prevent the electrical connection between the movable panel and the main body from being inadvertently interrupted, the movable panel is engaged to the main body at the closed position by appropriate locking means.

As described above, the detachable connector in the known front-panel device is formed such that, in the process of attachment of the male connector unit in the movable panel to the female connector unit in the main body, the convex contact comes into contact with the first and second female terminals, which are disposed substantially symmetrically with respect to a line, in an elastic manner by pushing the convex contact into the gap between the corresponding first and second female terminals. At this time, when the first and second female terminals which are disposed substantially symmetrically with respect to a line are obliquely in contact with the convex contact in an elastic manner, a component force of a terminal contact pressure functions as a reaction force of pushing the convex contact in a direction in which the convex contact is ejected. Therefore, if the total sum of the reaction forces produced by a plurality of sets of first and second female terminals is large, the movable panel and locking means for locking the movable panel may be plastically deformed under high temperatures or other conditions. One approach to addressing the problem is to reduce the terminal contact pressures of the first and second female terminals with respect to the convex contacts. However, this approach reduces the reliability of the electrical connection between the male connector unit and the female connector unit.

Another approach to this problem is to make the first and second female terminals, which are disposed substantially symmetrically with respect to a line, be in contact with the sides of the convex contacts in an elastic manner so that no terminal contact pressure may function as reaction forces of pushing the convex contacts in the direction in which the convex contacts are ejected. However, according to this approach, in the process of separating the male connector unit from the female connector unit, elastically contacted members of female terminals that have a longer distance to the axis of rotation of the movable panel, in the first female terminals and second female terminals, than the others cannot smoothly escape the convex contacts rotating integrally with the movable panel. This increases the risk of pushing the convex contacts in an undesired direction. As a result, another problem arises in which the relevant female terminals are prone to be damaged.

SUMMARY OF THE INVENTION

Accordingly, it is an object of the present invention to provide a detachable connector capable of maintaining a required terminal contact pressure without causing an excessive reaction force to be applied on a male connector unit attached to a female connector unit and capable of avoiding damage to the female terminal in the process of separation of the male connector unit from the female connector unit and to provide a front-panel device including the detachable connector.

According to a first aspect of the present invention, a detachable connector included in a front-panel device provided with a movable panel rotatable between a closed position in which a front portion of a main body of an apparatus is covered and an open position in which the front portion is exposed is provided. The detachable connector includes a male connector unit mounted to the movable panel and including a convex contact, and a female connector unit mounted to the main body and including a first female terminal and a second female terminal, the first and second female terminals being disposed on opposite sides of an insertion path for allowing the inserted convex contact to pass therethrough. The male connector unit is attachable to and detachable from the female connector unit with rotation of the movable panel. In the first and second female terminals, the first female terminal which has a longer distance to an axis of rotation of the movable panel includes a sloped portion for being obliquely in contact with the convex contact in an elastic manner, the second female terminal which has a shorter distance to the axis of rotation of the movable panel includes a contact portion for being in contact with a side of the convex contact in an elastic manner, and, when the male connector unit is attached to the female connector unit, a position where the sloped portion is in contact with the convex contact in an elastic manner is more distant from the movable panel in the main body than a position where the contact portion is in contact with the convex contact in an elastic manner.

As described above, when, in a pair of the female terminals in the female connector unit in the main body, the first female terminal that has a longer distance to the axis of rotation of the movable panel includes the sloped portion for being in contact with the convex contact from obliquely above in an elastic manner, the convex contact can smoothly escape in the process of separation of the male connector unit from the female connector unit. As a result, the detachable connector prevents the first female terminal from being damaged, thus increasing the longevity of the detachable connector. Additionally, when the second female terminal that has a shorter distance to the axis of rotation of the movable panel includes the contact portion for being in contact with the convex contact from a side in an elastic manner, if a position where the sloped portion is in contact with the convex contact in an elastic manner is more distant from the movable panel in the main body than a position where the contact portion is in contact with the convex contact in an elastic manner, a reaction force of pushing the convex contact in a direction in which the convex contact is ejected is reduced by a friction force produced by the contact portion. Therefore, a required terminal contact pressure can be maintained without causing an excessive reaction force to be applied on the male connector unit being attached to the female connector unit. As a result, the reliability of an electrical connection is assured, and the movable panel and the locking means for locking the movable panel are prevented from being plastically deformed.

In the structure described above, the sloped portion may be disposed adjacent to a free end of the first female terminal, and a leading-end corner of the convex contact inserted into the insertion path may slide on the sloped portion toward a section adjacent to the free end in the sloped portion. This is preferable because the sloped portion, which is in contact with the adjacent section of the leading end of the convex contact inserted into the insertion path in an elastic manner with reliability and which avoids the possibility of interfering with the operation of ejecting the convex contact, is easily created.

According to an embodiment of the present invention, in first and second female terminals, a first female terminal which has a longer distance to an axis of rotation of a movable panel includes a sloped portion for being in contact with a convex contact of a male connector unit mounted to the movable panel in an elastic manner from obliquely above. This allows the convex contact to smoothly escape in the process of separating of the male connector unit. Additionally, the second female terminal which has a shorter distance to the axis of rotation of the movable panel includes a closed position for being in contact with the side surface of the convex contact in an elastic manner. This prevents the terminal contact pressure of the contact portion from functioning as a reaction force for pushing the convex contact in a direction in which the convex contact is ejected. Furthermore, a position where the sloped portion is in contact with the convex contact in an elastic manner is set so as to be more distant from the movable panel in the main body than a position where the contact portion is in contact with the convex contact in an elastic manner, and therefore, the reaction force of pushing the convex contact in a direction in which the convex contact is ejected is reduced by a friction force at the contact portion.

In a detachable connector according to the embodiment of the present invention, a pair of female terminals is not substantially symmetrically disposed with respect to a line. A first female terminal includes a sloped portion for being obliquely in contact with a convex contact of a male connector unit mounted to a movable panel in an elastic manner so that the convex contact can smoothly escape. Additionally, a second female terminal includes a contact portion for being in contact with the convex contact from a side in an elastic manner so that the convex contact will not be excessively pushed in a direction in which the convex contact is ejected in the process of attachment of the male connector unit to the female connector unit. Therefore, a required terminal contact pressure is maintained without causing an excessive reaction force to be applied on the male connector unit being attached to the female connector unit. Therefore, the reliability of an electrical connection is assured, and the movable panel and the locking means for locking the movable panel are prevented from being damaged. At the same time, the female terminal is prevented from being plastically deformed in the process of separating of the male connector unit from the female connector unit, thus increasing the longevity of the detachable connector.

DESCRIPTION OF THE PREFERRED EMBODIMENTS

Figure 1:
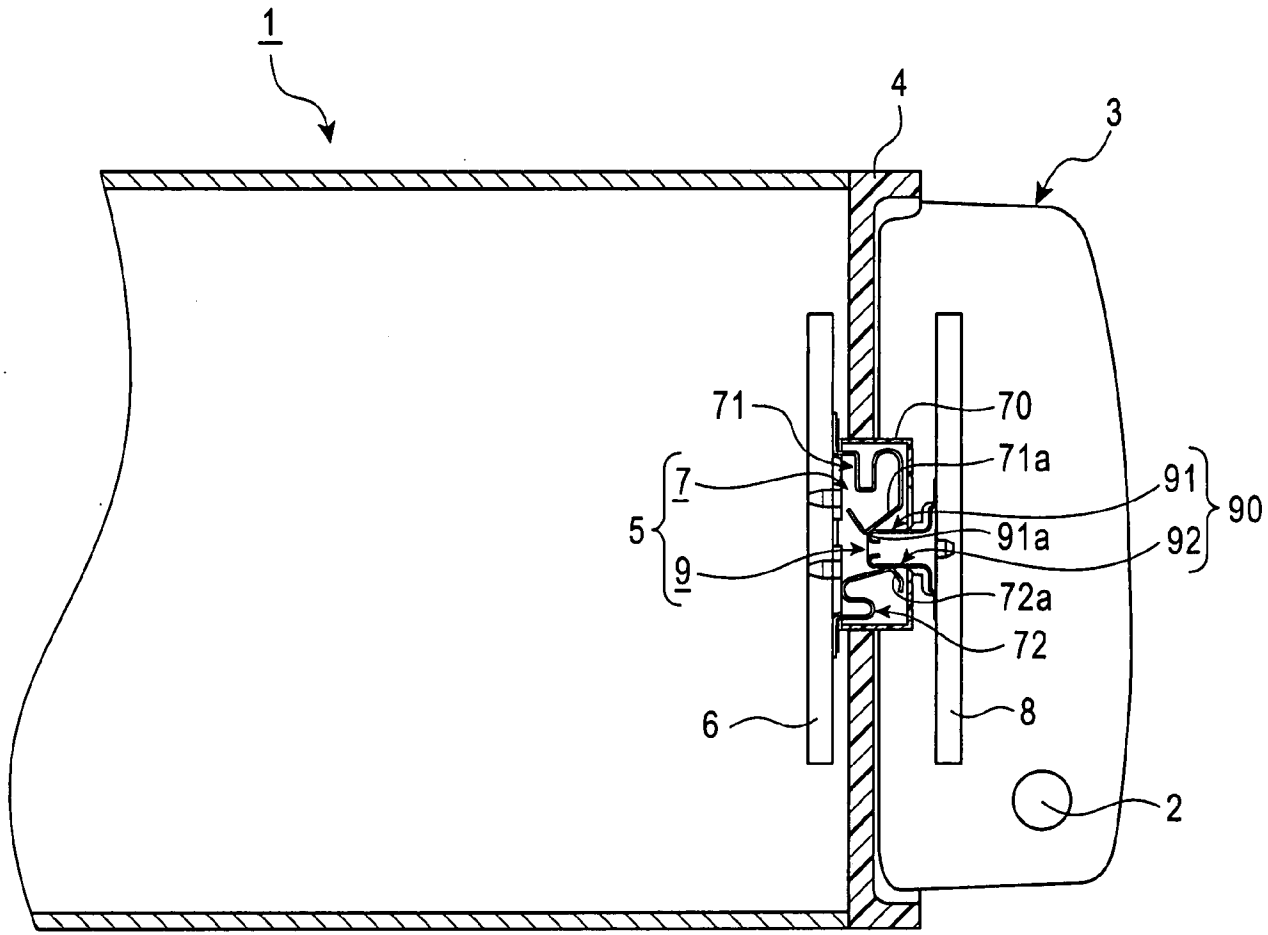
FIG. 1 illustrates a front-panel device including a detachable connector with a movable panel being at a closed state according to an embodiment of the present invention.
Figure 2:
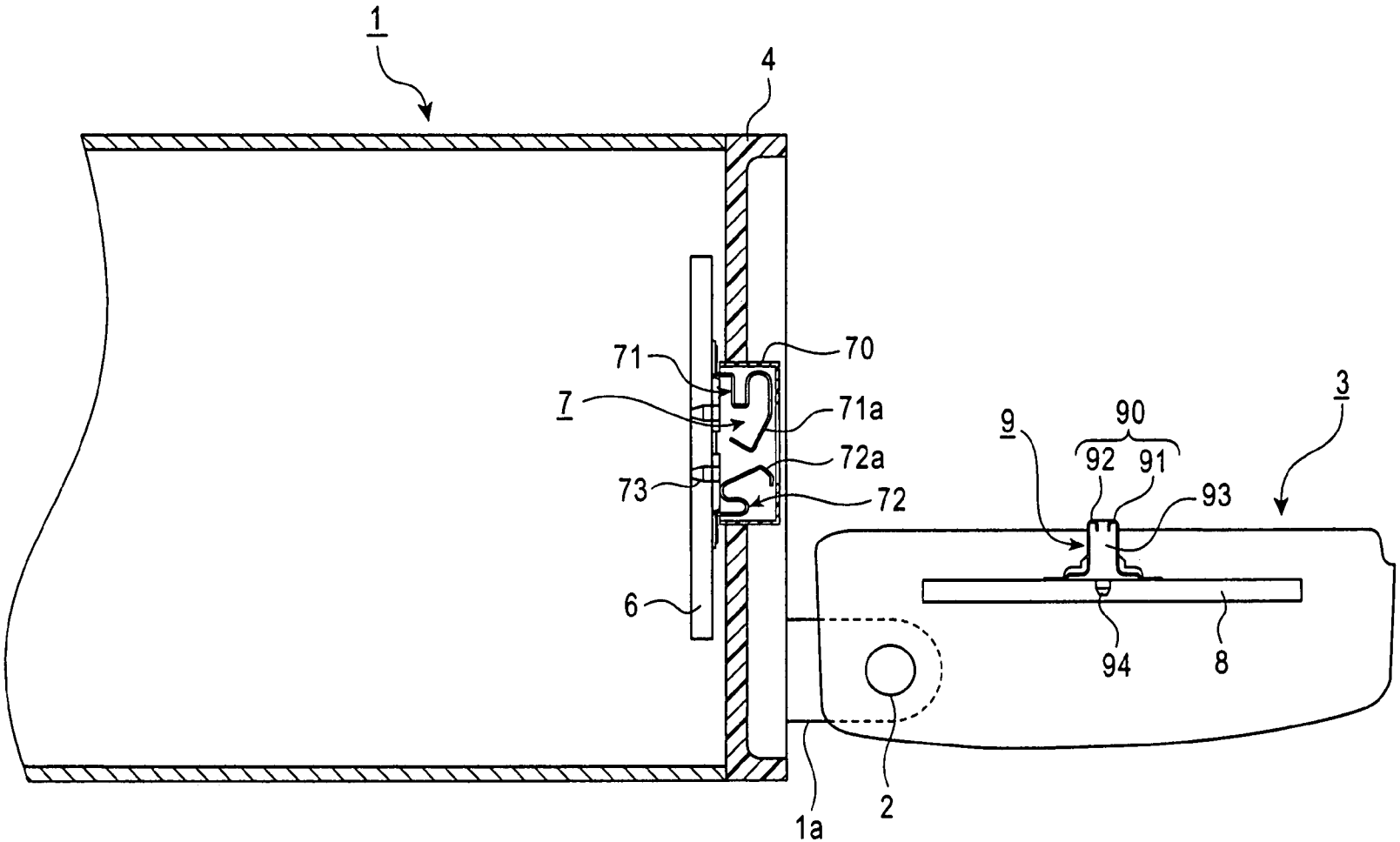
FIG. 2 illustrates the front-panel device with the movable panel being at an open state.

In a front-panel device in a vehicle-mounted electronic apparatus shown in FIGS. 1 and 2, a movable panel 3 is detachably and rotatably mounted on a supporting shaft 2 mounted on an arm 1*a* of a main body 1 of the apparatus. The main body 1 includes a loading slot (not shown) for inserting and ejecting a medium (e.g., MD or CD) formed at a front portion 4. At the movable panel 3, a display screen (not shown) and various operating keys (not shown) are arranged. The main body 1 and movable panel 3 are electrically connected to each other with a detachable connector 5 disposed therebetween. The detachable connector 5 includes a female connector unit 7 connected to a circuit board 6 incorporated in the main body 1 and a male connector unit 9 connected to a circuit board 8 incorporated in the movable panel 3.

Figure 3:
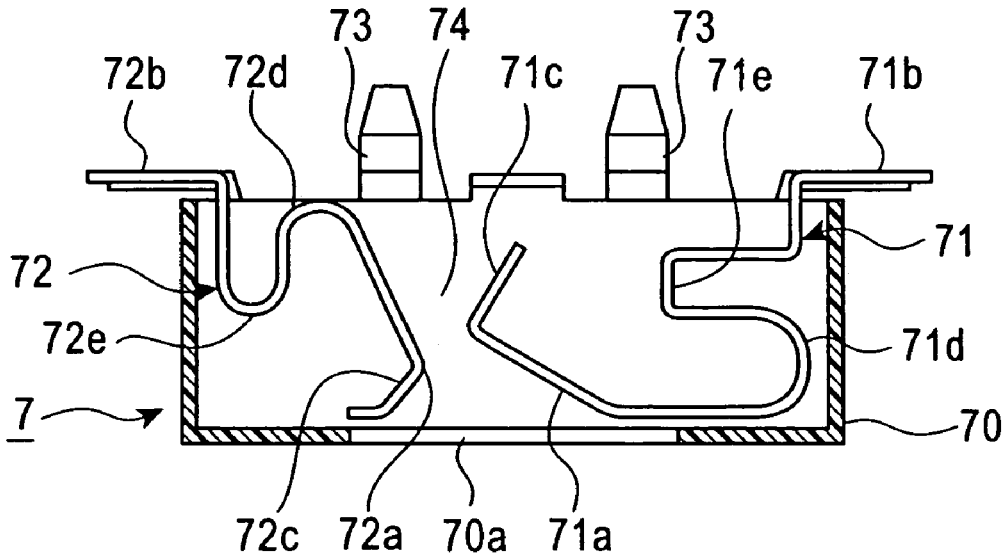
FIG. 3 is a cross-sectional view of a female connector unit of the detachable connector.
Figure 4:
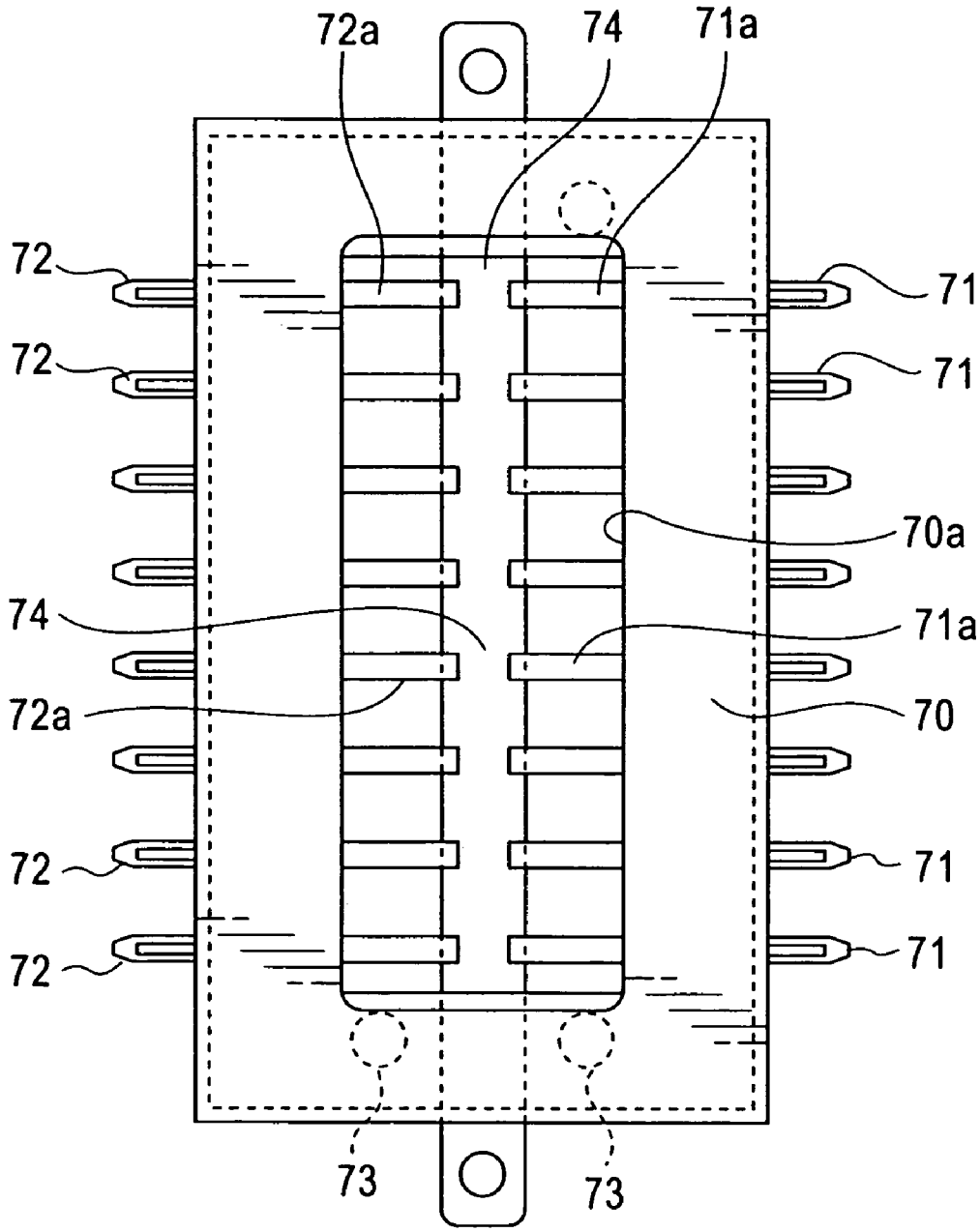
FIG. 4 is a plan view of the female connector unit.

As shown in FIGS. 3 and 4, the female connector unit 7 includes a synthetic-resin cover 70 having a window 70*a*, first female terminals 71 each including a sloped portion 71*a*, second female terminals 72 each including a contact portion 72*a*, and legs 73 for being fit in locating holes formed in the circuit board 6. The first female terminals 71 and the opposite second female terminals 72 are arranged in eight pairs in parallel. Each of the first female terminals 71 and second female terminals 72 is formed from a conductive metal plate subjected to bending. The sloped portion 71*a* extends from a leading-end portion 71*c* of the first female terminal 71 at a substantially right angle and has the shape of a strip facing the window 70*a*. The contact portion 72*a* is a bend nearest the sloped portion 71*a* in the vicinity of a leading-end portion 72*c*. For the first female terminal 71 and second female terminal 72 in each pair, the gap between the sloped portion 71*a* and contact portion 72*a* forms an insertion path 74 for allowing a corresponding convex contact 90 of the male connector unit 9 inserted with force to pass therethrough. Since a free end of the first female terminal 71 and that of the second female terminal 72 are prone to being elastically deformed, the sloped portion 71*a* and the contact portion 72*a* are capable of approaching and moving away from each other on opposite sides of the corresponding insertion path 74. The leading-end portion 71*c* of the first female terminal 71 obliquely extends in a direction away from the insertion path 74 relative to a section adjacent to a free end in the sloped portion 71*a*. Similarly, the leading-end portion 72*c* of the second female terminal 72 obliquely extends in a direction away from the insertion path 74 relative to the contact portion 72*a*. Therefore, in the process of inserting the convex contact 90 of the male connector unit 9 into the insertion path 74 and separating the convex contact 90 from the insertion path 74, the sloped portion 71*a* and contact portion 72*a* are not caught on the convex contact 90. The first female terminal 71 includes substantially U-shaped curved portions 71*d* and 71*e* continuously formed between the sloped portion 71*a* and a base-end portion 71*b*. Each of the curved portions 71*d* and 71*e* has a U-shape with an open section in a direction (horizontal direction in FIG. 3) substantially perpendicular to a direction in which the convex contact 90 is inserted and separated with respect to the insertion path 74 (vertical direction in FIG. 3). The curved portions 71*d* and 71*e* function to prevent a stress from being applied on the base-end portion 71*b* when the sloped portion 71*a* is pushed and bent. Similarly, the second female terminal 72 includes substantially U-shaped curved portions 72*d* and 72*e* continuously formed between the sloped portion 72*a* and a base-end portion 72*b*. Each of the curved portions 72*d* and 72*e* has a U-shape with an open section in a direction (vertical direction in FIG. 3) substantially parallel to the direction in which the convex contact 90 is inserted and separated with respect to the insertion path 74. The curved portions 72*d* and 72*e* function to prevent a stress from being applied on the base-end portion 72*b* when the contact portion 72*a* is pushed and bent. The base-end portion 71*b* of the first female terminal 71 and the base-end portion 72*b* of the second female terminal 72 extend in directions away from each other, protrude from the cover 70, and are fixed to a land portion of the circuit board 6 by soldering. As is evident from FIGS. 1 and 2, in a pair of the first female terminal 71 and second female terminal 72, the distance from the upper first female terminal 71 to the axis of rotation (supporting shaft 2) of the movable panel 3 is longer than the distance from the lower second female terminal 72 to the axis of rotation of the movable panel 3.

Figure 5:
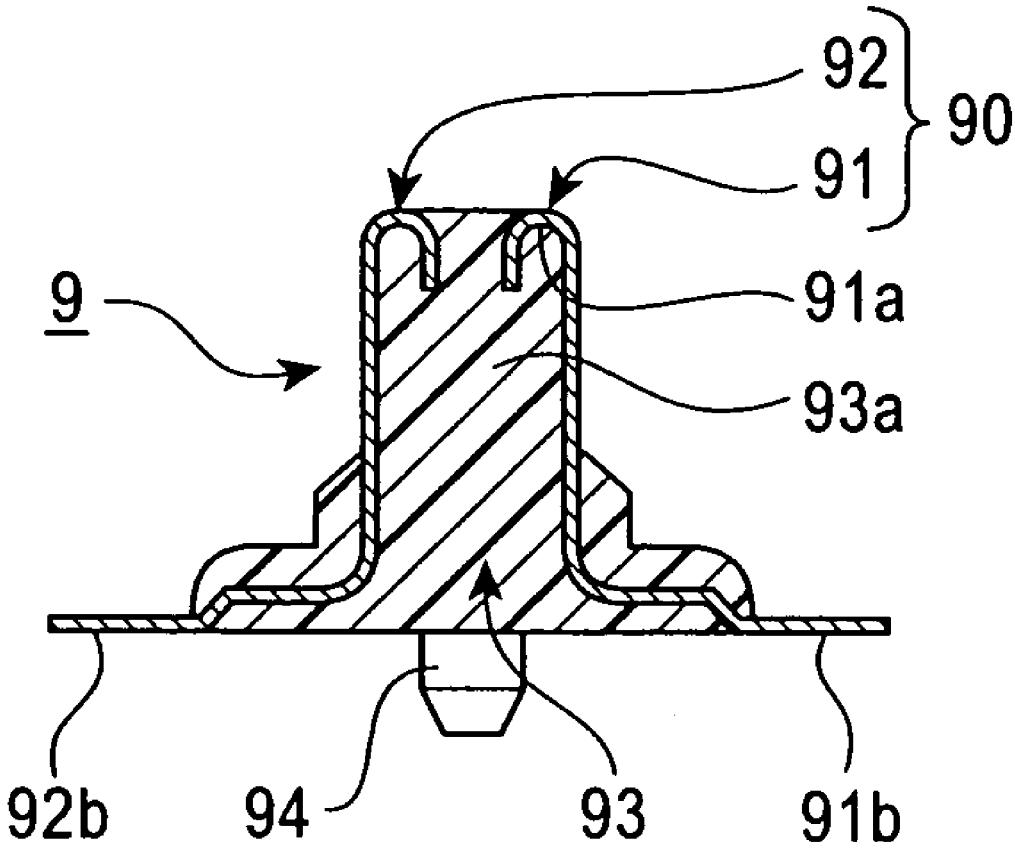
FIG. 5 is a cross-sectional view of a male connector unit of the detachable connector.
Figure 6:
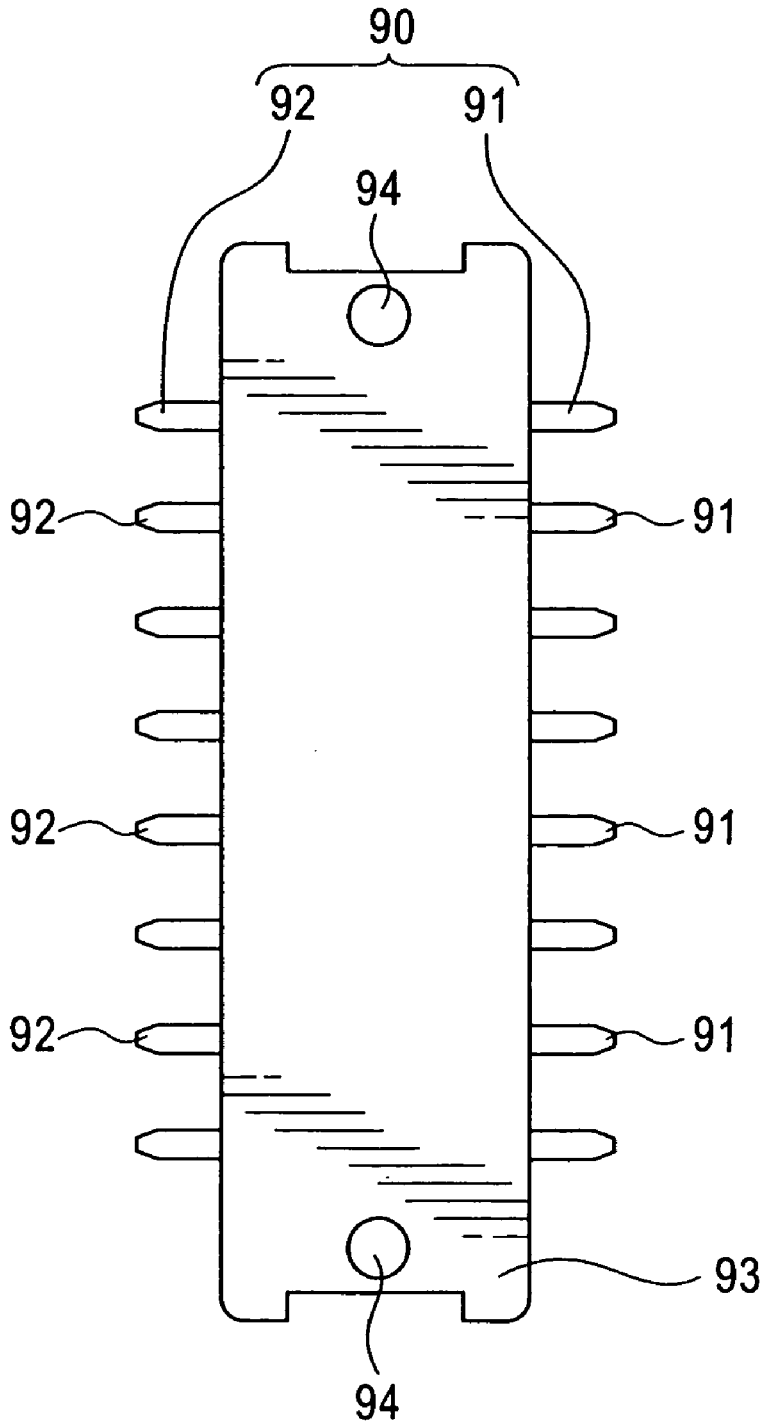
FIG. 6 is a plan view of the male connector unit.

As shown in FIGS. 5 and 6, the male connector unit 9 includes the convex contacts 90 each including first and second male terminals 91 and 92 which are symmetrically disposed with respect to a line, a synthetic-resin body 93 having a projection 93*a* whose leading end is covered, and legs 94 for being fit in locating holes formed in the circuit board 8. The eight convex contacts 90 are arranged in parallel in the direction of the length of the body 93. Each of the first male terminals 91 and second male terminal 92, which constitute the convex contact 90, is formed from a conductive metal plate subjected to bending and is integrally formed with the body 93 by insert molding. The base-end portion 91*b* of the first male terminal 91 and the base-end portion 92*b* of the second male terminal 92 extend in directions away from each other, protrude from the body 93, and are fixed to a land portion of the circuit board 8 by soldering.

The first female terminal 71 and second female terminal 72 in each pair may be disposed at positions other than at opposed positions on opposite sides of the insertion path 74. For example, the first female terminals 71 may be slightly displaced in the direction (vertical direction in FIG. 4) in which the first female terminals 71 are arranged so as to be opposed to the corresponding gaps between the second female terminals 72. In this case, the first male terminals 91 of the male connector unit 9 corresponding to the first female terminals 71 are similarly displaced in the direction in which they are arranged.

In the front-panel device according to the embodiment, the movable panel 3 is rotatable between the closed position (upright posture), as shown in FIG. 1, and the open position (horizontal posture), as shown in FIG. 2, about the supporting shaft 2. Setting the movable panel 3 upright covers the front portion 4 of the main body 1 with the display screen and various operating keys, whereas setting the movable panel 3 horizontal exposes a loading slot for a CD, MD, or the like. In addition, since the movable panel 3 is detachable from the supporting shaft 2, the vehicle-mounted electronic apparatus can be set to appear as a semifinished product when a driver is not in a car by removing the movable panel 3 from the main body 1. This enhances the effect of protecting the electronic apparatus from theft.

The operation of the detachable connector 5 is described below. When the movable panel 3 is at the closed position, in which the front portion 4 of the main body 1 is covered, as shown in FIG. 1, the male connector unit 9 mounted to the movable panel 3 is attached to the female connector unit 7 mounted to the main body 1. At this time, the convex contacts 90 are pushed into the corresponding insertion paths 74 between the first and second female terminals 71 and 72 in the female connector unit 7, the free-end sections of the sloped portions 71*a* are obliquely in contact with corresponding leading-end corners 91*a* of the first male terminals 91 in an elastic manner, and the contact portions 72*a* are in contact with the corresponding side surfaces of the second male terminals 92 at a substantially right angle in an elastic manner. This maintains an electrical connection between the female connector unit 7 and the male connector unit 9, thus allowing transmission and reception of electrical signals between the main body 1 and the display screen and various operating keys arranged on the movable panel 3. At this closed state, the movable panel 3 is engaged to the main body 1 by locking means (not shown).

When the CD loading slot or MD loading slot formed at the front portion 4 of the main body 1 is required to be exposed, the engagement performed by the locking means is released and the movable panel 3 is rotated frontward about the supporting shaft 2 to set the movable panel 3 at the horizontal position, as shown in FIG. 2. When the loading slot at front portion 4, which was covered with movable panel 3, is exposed, the insertion and ejection operations of a medium, such as a CD, MD, or the like, are allowed, and the electrical connection between the movable panel 3 and the main body 1 is released because the convex contact 90 of the male connector unit 9 moves away from the first and second female terminals 71 and 72 of the female connector unit 7.

Figure 7:
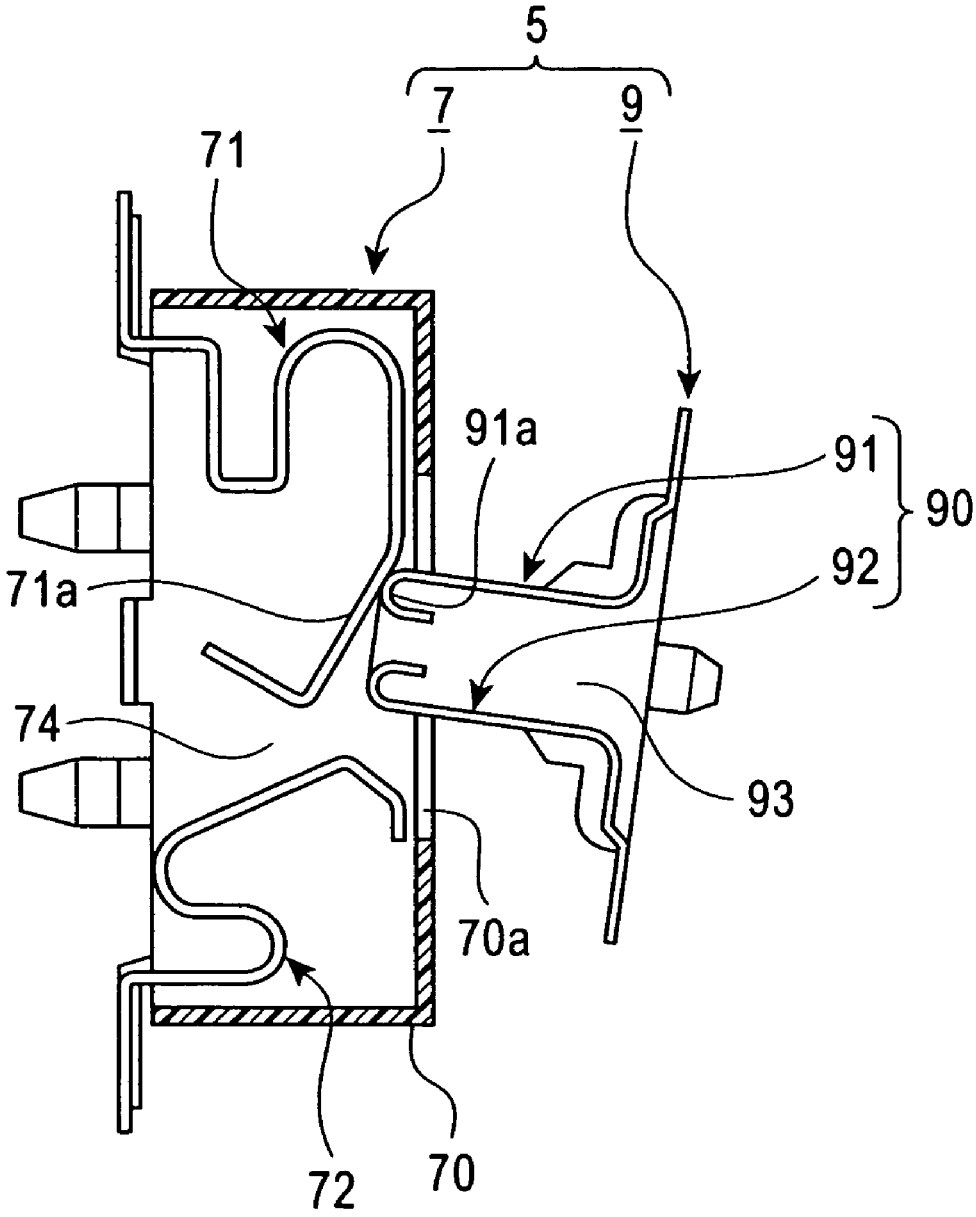
FIG. 7 is an illustration for explanation of an operation in a process of attachment of the male connector unit to the female connector unit.
Figure 8:
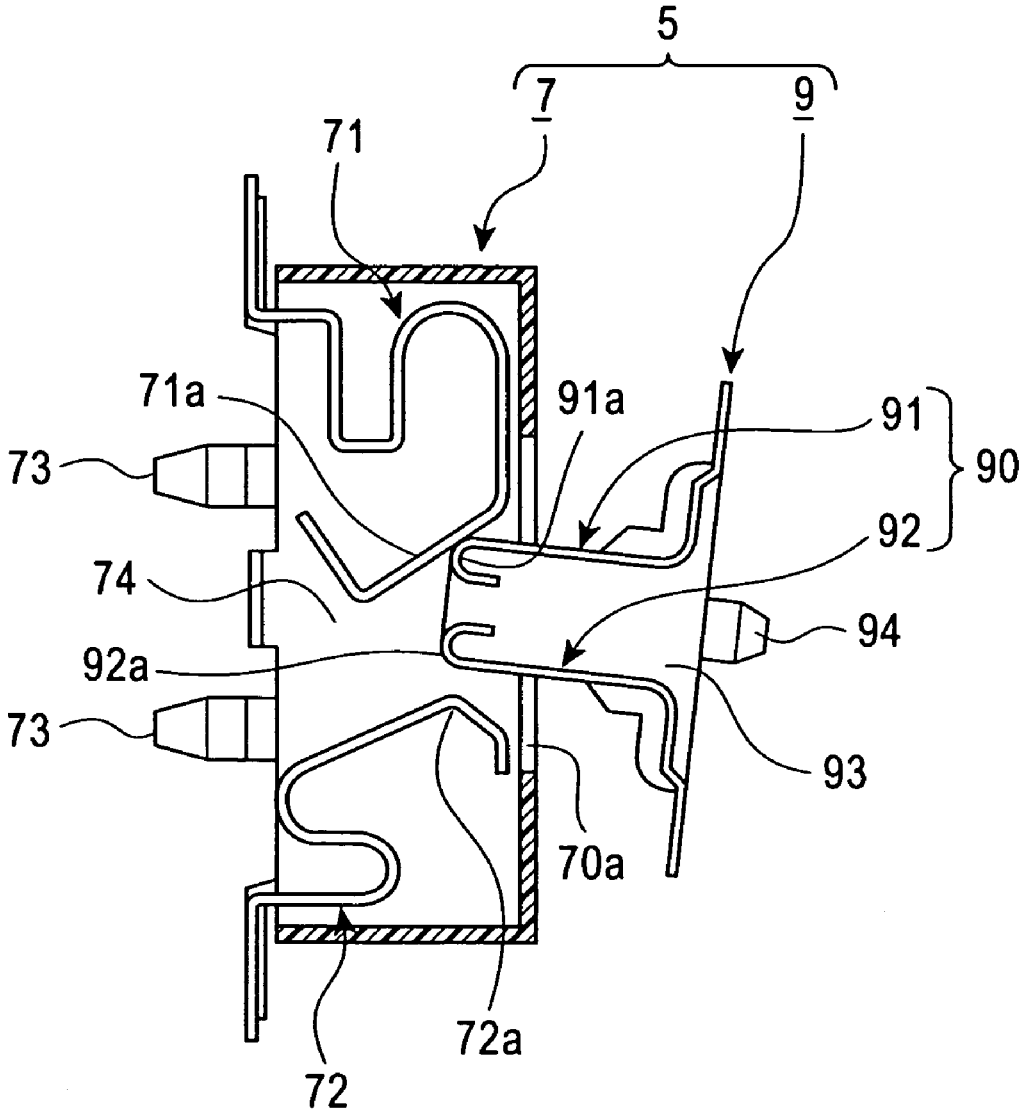
FIG. 8 is an illustration for explanation of the further operation in the process of attachment of the male connector unit to the female connector unit.
Figure 9:
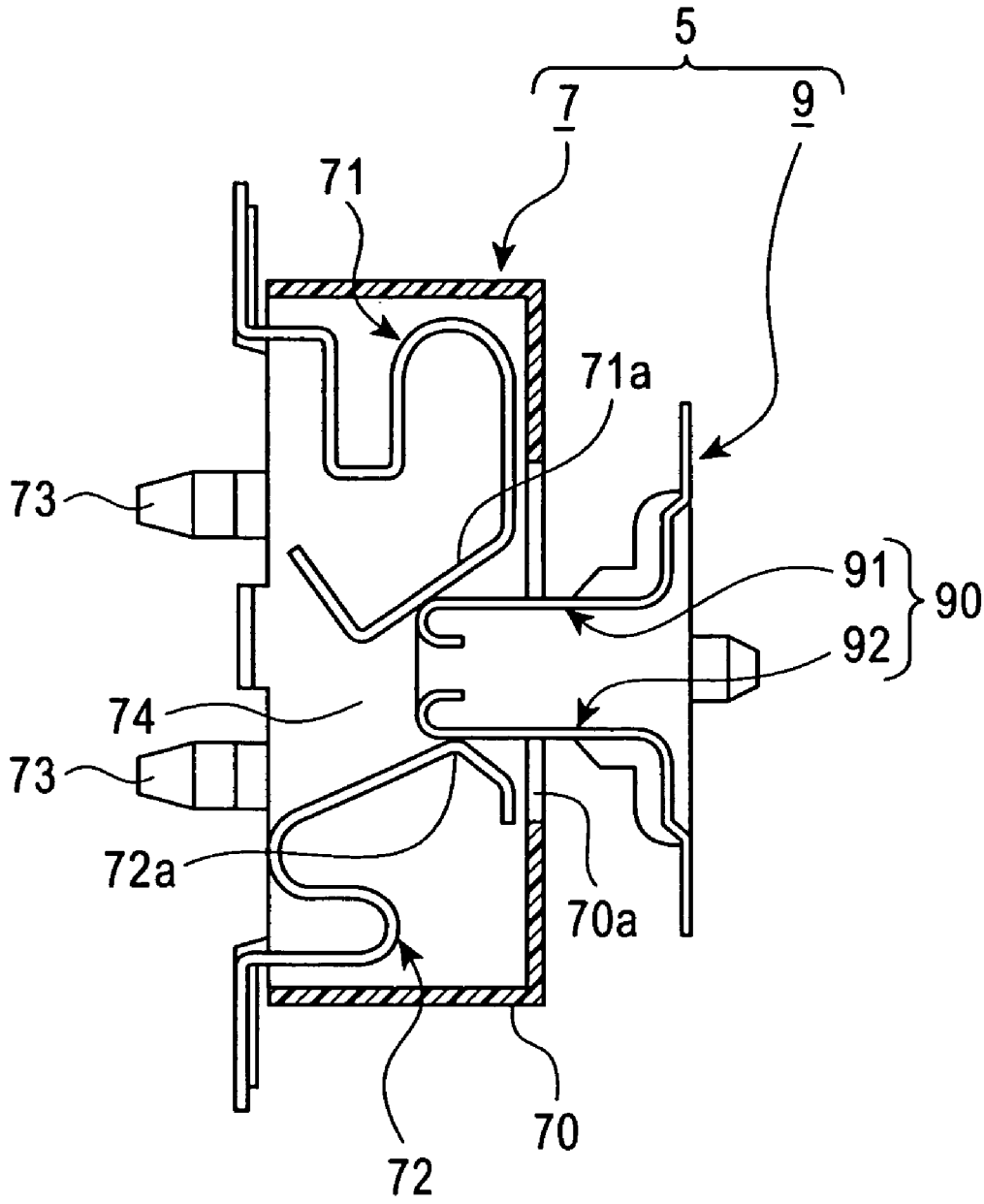
FIG. 9 is an illustration for explanation of the further operation in the process of attachment of the male connector unit to the female connector unit.

The operation of the detachable connector 5 is described in greater detail below with reference to FIGS. 7 to 10. In the process of rotation of the movable panel 3 toward the closed position, when the convex contact 90 of the male connector unit 9 enters the window 70*a*, as shown in FIG. 7, the leading-end corner 91*a* of the first male terminal 91 of the convex contact 90 comes into contact with a section adjacent to the base end in the sloped portion 71*a*. Then, as the movable panel 3 is rotated further, the leading end portion of the convex contact 90 is inserted into the corresponding insertion path 74 between the first and second female terminals 71 and 72, and at the same time, the leading-end corner 91*a* of the first male terminal 91 slides on the sloped portion 71*a* while pushing the sloped portion 71*a* obliquely upward. When the movable panel 3 is further rotated toward the closed position, the leading-end portion of the convex contact 90 is further inserted into the corresponding insertion path 74, as shown in FIG. 9. Therefore, the leading-end corner 91*a* slides on the sloped portion 71*a* toward the free-end section of the sloped portion 71*a*, and at the same time, the contact portion 72*a* comes into contact with the side surface of the second male terminal 92 of the convex contact 90 from below in an elastic manner. In the process of insertion of the convex contact 90 into the insertion path 74, the contact portion 72*a* is not in contact with a leading-end corner 92*a* of the second male terminal 92 (see FIG. 8), thus resulting in reduced insertion resistance of the convex contact 90.

Figure 10:
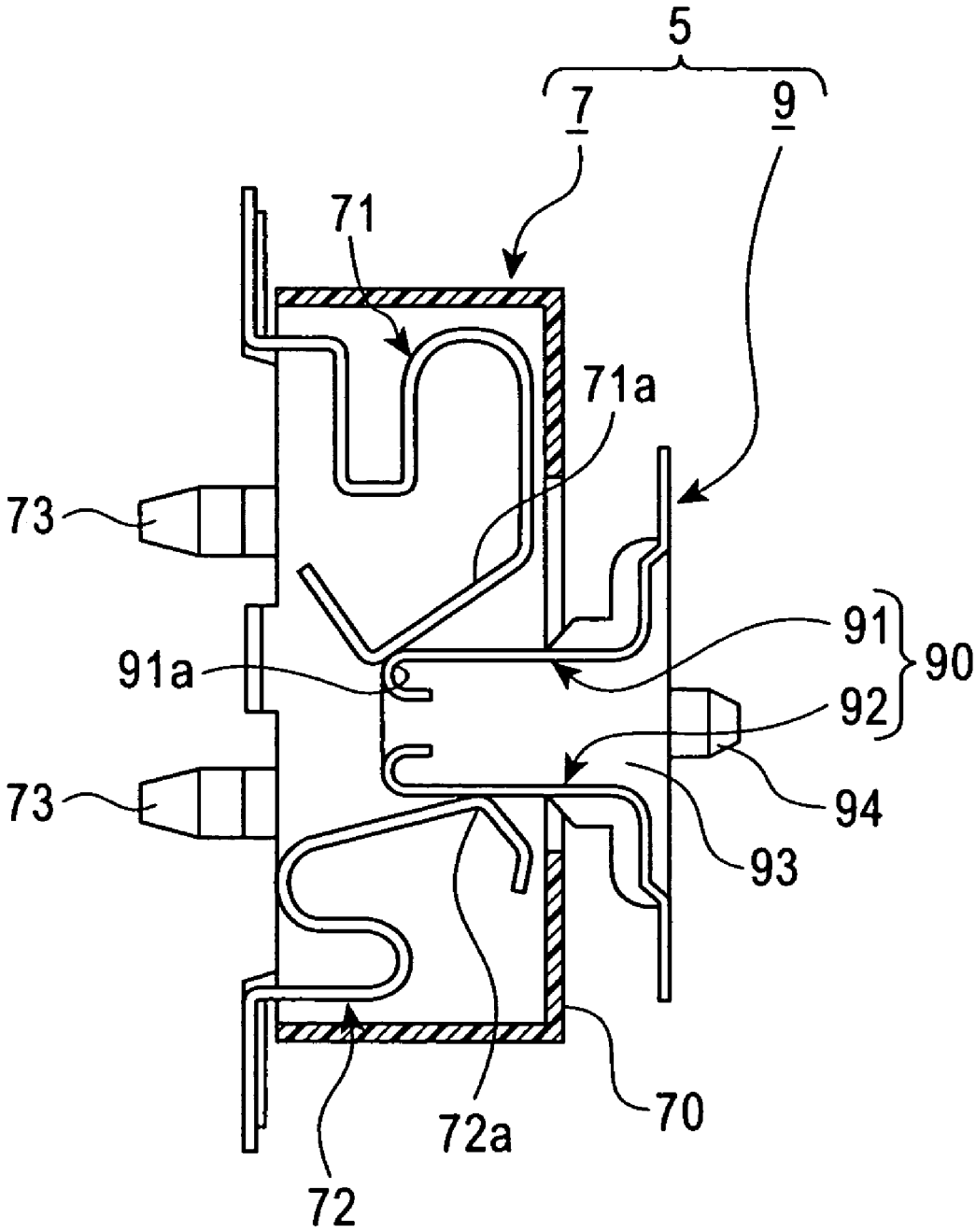
FIG. 10 is an illustration showing when attachment of the male connector unit to the female connector unit is completed.

As the movable panel 3 is further rotated, the second male terminal 92 enters the insertion path 74 while pushing the contact portion 72*a* of the second female terminal 72 downward. When the movable panel 3 is moved to the closed position, as shown in FIG. 10, the free-end section of the sloped portion 71*a* is in contact with the leading-end corner 91*a* of the first male terminal 91 from obliquely above in an elastic manner, and at the same time, the second female terminal 72 is in contact with the side surface of the second male terminal 92 at a section near the central portion from below in an elastic manner. As a result, when the movable panel 3 is maintained at the closed position, the first and second male terminals 91 and 92 are in contact with the corresponding first and second female terminals 71 and 72 in an elastic manner, and the male connector unit 9 is maintained so as to be attached to the female connector unit 7.

To separate the male connector unit 9 from the female connector unit 7, the reverse procedure is followed, so that the state shifts from FIG. 10 to FIG. 7 successively. In this case, since the leading-end corner 91*a* of the convex contact 90 pushes the sloped portion 71*a* while moving obliquely upward, the free-end section of the sloped portion 71*a* is not caught on the leading-end corner 91*a* of the convex contact 90 and is not pushed in an undesired direction. Therefore, the convex contact 90 can smoothly escape.

As described above, in the detachable connector 5 according to the embodiment, the male connector unit 9 mounted to the movable panel 3 is attached to and detached from the female connector unit 7 mounted to the main body 1. When the male connector unit 9 is attached to the female connector unit 7, a first one (the first female terminal 71) of the first and second female terminals 71 and 72 is in contact with the corresponding convex contact 90 of the male connector unit 9 from obliquely above in an elastic manner, and a second one (the second female terminal 72) is in contact with the convex contact 90 from below in an elastic manner. In other words, the first and second female terminals 71 and 72 are not symmetrically disposed with respect to a line. The first female terminal 71 which has a longer distance to the axis of rotation of the movable panel 3 includes the sloped portion 71*a* for being in contact with the leading-end corner 91*a* of the convex contact 90 from obliquely above in an elastic manner, thus allowing the convex contact 90 to smoothly escape in the process of separation of the male connector unit 9 from the female connector unit 7. As a result, the detachable connector 5 prevents the first female terminal 71 from being damaged in the process of separation of the male connector unit 9 from the female connector unit 7, thus increasing the longevity of the detachable connector 5.

Additionally, in the detachable connector 5 according to the embodiment, the second female terminal 72 which has a shorter distance to the axis of rotation of the movable panel 3 includes the contact portion 72*a* for being in contact with the side surface of the convex contact 90 from below in an elastic manner. When the male connector unit 9 is attached to the female connector unit 7, the terminal contact pressure of the contact portion 72*a* does not function as a reaction force of pushing the convex contact 90 in a direction in which the convex contact 90 is ejected (direction in which the convex contact 90 is removed from the female connector unit 7), and at the same time, a position where the sloped portion 71*a* is in contact with the convex contact 90 in an elastic manner is more distant from the movable panel 3 in the main body 1 than a position where the contact portion 72*a* is in contact with the convex contact 90 in an elastic manner. In other words, in the detachable connector 5, although a reaction force of pushing the convex contact 90 in a direction in which the convex contact 90 is ejected occurs as a component force of a terminal contact pressure at the sloped portion 71*a*, the reaction force is reduced by a friction force at the contact portion 72*a*. Therefore, a required terminal contact pressure can be maintained without causing an excessive reaction force to be applied on the male connector unit 9 attached to the female connector unit 7 in a direction in which the male connector unit 9 is ejected. The reliability of an electrical connection can be assured. The movable panel 3 and the locking means for locking the movable panel 3 can be prevented from being plastically deformed. The stress applied on the circuit board 6 and circuit board 8 can be reduced.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

The invention claimed is:

1. A detachable connector included in a front-panel device provided with a movable panel rotatable between a closed position in which a front portion of a main body of an apparatus is covered and an open position in which the front portion is exposed, the detachable connector comprising:

a male connector unit mounted to one of the movable panel and the main body and including a convex contact; and a female connector unit mounted to the other of the movable panel and the main body and including a first female terminal and a second female terminal, the first and second female terminals being disposed on opposite sides of an insertion path for allowing the inserted convex contact to pass therethrough, the male connector unit being attachable to and detachable from the female connector unit with rotation of the movable panel, wherein the first female terminal has a longer distance to an axis of rotation of the movable panel and includes a sloped portion for being obliquely in contact with the convex contact in an elastic manner, the second female terminal has a shorter distance to the axis of rotation of the movable panel and includes a contact portion for being in contact with a side of the convex contact in an elastic manner, and, when the male connector unit is attached to the female connector unit, a position where the sloped portion is in contact with the convex contact in an elastic manner is more distant from a base end portion of the convex contact than a position where the contact portion is in contact with the convex contact in an elastic manner.

2. The detachable connector according to claim 1, wherein a free end portion of the second female terminal is sloped and extends in a direction away from the insertion path relative to the contact portion.

3. The detachable connector according to claim 1, wherein the contact portion is disposed such that the contact portion is not in contact with a leading-end corner of the convex contact in a process of insertion of the convex contact into the insertion path.

4. The detachable connector according to claim 1, wherein the sloped portion is disposed near a free end of the first female terminal, and a leading-end corner of the convex contact inserted into the insertion path slides on the sloped portion toward a section adjacent to the free end in the sloped portion.

5. The detachable connector according to claim 4, wherein a free end portion of the first female terminal is sloped and extends in a direction away from the insertion path relative to the free-end section of the sloped portion.

6. The detachable connector according to claim 1, wherein a base end portion of the first female terminal is fixed to a circuit board, and the first female terminal includes a substantially U-shaped curved portion between the sloped portion and the base end portion.

7. The detachable connector according to claim 6, wherein the curved portion has a substantially U shape with an open section in a direction substantially perpendicular to a direction of insertion of the convex contact with respect to the insertion path.

8. The detachable connector according to claim 1, wherein a base end portion of the second female terminal is fixed to a circuit board, and the second female terminal includes a substantially U-shaped curved portion between the contact portion and the base end portion.

9. The detachable connector according to claim 8, wherein the curved portion has a substantially U shape with an open section in a direction substantially parallel to a direction of insertion of the convex contact with respect to the insertion path.

10. A front-panel device comprising:

a movable panel rotatable between a closed position in which a front portion of a main body of an apparatus is covered and an open position in which the front portion is exposed;

a male connector unit mounted to the movable panel and including a convex contact; and a female connector unit mounted to the main body and including a first female terminal and a second female terminal, the first and second female terminals being disposed on opposite sides of an insertion path for allowing the inserted convex contact to pass therethrough, the male connector unit being attachable to and detachable from the female connector unit with rotation of the movable panel, wherein the first female terminal has a longer distance to an axis of rotation of the movable panel and includes a sloped portion for being obliquely in contact with the convex contact in an elastic manner, the second female terminal has a shorter distance to the axis of rotation of the movable panel and includes a contact portion for being in contact with a side of the convex contact in an elastic manner, and, when the male connector unit is attached to the female connector unit, a position where the sloped portion is in contact with the convex contact in an elastic manner is more distant from the movable panel than a position where the contact portion is in contact with the convex contact in an elastic manner.

11. The front-panel device according to claim 10, wherein a free end portion of the second female terminal is sloped and extends in a direction away from the insertion path relative to the contact portion.

12. The front-panel device according to claim 10, wherein the contact portion is disposed such that the contact portion is not in contact with a leading-end corner of the convex contact in a process of insertion of the convex contact into the insertion path.

13. The front-panel device according to claim 10, wherein the sloped portion is disposed near to a free end of the first female terminal, and a leading-end corner of the convex contact inserted into the insertion path slides on the sloped portion toward a section adjacent to the free end in the sloped portion.

14. The front-panel device according to claim 13, wherein a free end portion of the first female terminal is sloped and extends in a direction away from the insertion path relative to the free-end section of the sloped portion.

15. The front-panel device according to claim 10, wherein a base end portion of the first female terminal is fixed to a circuit board incorporated in the main body, and the first female terminal includes a substantially U-shaped curved portion between the sloped portion and the base end portion.

16. The front-panel device according to claim 15, wherein the curved portion has a substantially U shape with an open section in a direction substantially perpendicular to a direction of insertion of the convex contact with respect to the insertion path.

17. The front-panel device according to claim 10, wherein a base end portion of the second female terminal is fixed to a circuit board incorporated in the main body, and the second female terminal includes a substantially U-shaped curved portion between the contact portion and the base end portion.

18. The front-panel device according to claim 17, wherein the curved portion has a substantially U shape with an open section in a direction substantially parallel to a direction of insertion of the convex contact with respect to the insertion path.

19. A vehicle-mounted electronic apparatus including the front-panel device according to any one of claim 10 to 18.

* * * * *